US010765905B2

(12) United States Patent
Wang et al.

(10) Patent No.: US 10,765,905 B2
(45) Date of Patent: Sep. 8, 2020

(54) EXERCISE BALL

(71) Applicant: The University of Texas at Tyler, Tyler, TX (US)

(72) Inventors: Yong Tai Wang, Tyler, TX (US); Chung Hyun Goh, Tyler, TX (US); Weerawat Limroongreugrat, Tyler, TX (US); Ting Liao, Tyler, TX (US)

(73) Assignee: THE UNIVERSITY OF TEXAS AT TYLER, Tyler, TX (US)

( * ) Notice: Subject to any disclaimer, the term of this patent is extended or adjusted under 35 U.S.C. 154(b) by 83 days.

(21) Appl. No.: 15/896,755

(22) Filed: Feb. 14, 2018

(65) Prior Publication Data

US 2019/0247702 A1 Aug. 15, 2019

(51) Int. Cl.

| | |
|---|---|
| ***A63B 21/072*** | (2006.01) |
| ***A63B 21/00*** | (2006.01) |
| ***A63B 23/035*** | (2006.01) |

(52) U.S. Cl.

CPC .... *A63B 21/0722* (2015.10); *A63B 21/00069* (2013.01); *A63B 23/03516* (2013.01)

(58) Field of Classification Search

CPC ..... A63B 21/07; A63B 23/03516; A63B 21/0006

See application file for complete search history.

(56) References Cited

U.S. PATENT DOCUMENTS

| | | | | | |
|---|---|---|---|---|---|
| 4,801,140 | A * | 1/1989 | Bergeron | A63B 21/0004 | 280/87.01 |
| 4,880,228 | A * | 11/1989 | Caruthers | A63B 21/0605 | 482/108 |
| 5,222,929 | A * | 6/1993 | Duda | A63B 21/0603 | 482/1 |
| 5,242,348 | A * | 9/1993 | Bates | A63B 21/0004 | 482/105 |
| 5,250,014 | A * | 10/1993 | Chang | A63B 21/075 | 482/106 |
| D435,613 | S * | 12/2000 | Quitter | D21/714 | |
| 6,190,292 | B1 * | 2/2001 | Panes | A63B 21/06 | 482/109 |
| 6,387,022 | B1 * | 5/2002 | Smith | A63B 43/02 | 482/106 |
| 6,527,675 | B1 * | 3/2003 | Yu | A63B 21/22 | 482/110 |
| 6,530,845 | B1 * | 3/2003 | Corbett | A63B 69/3632 | 473/219 |
| 6,629,908 | B2 * | 10/2003 | Hamady | A63B 21/22 | 482/110 |
| 6,773,377 | B1 * | 8/2004 | Yu | A61H 7/003 | 482/108 |

(Continued)

*Primary Examiner* — Garrett K Atkinson
(74) *Attorney, Agent, or Firm* — Kirby Drake

(57) ABSTRACT

An exercise ball may provide two independent sections, a first separable section and a second separable section, that a user may utilize for weight training and mind-body exercises. The first separable section and the second separable section may be held by a user in opposite hands for weight training and other exercises. The exercise ball may be a Tai Chi ball that may include a plurality of polymagnets provided in an interior of the exercise ball that may keep the two separable sections together. The plurality of polymagnets may provide a push-release or twist-release attachment and detachment to attach and detach the sections.

14 Claims, 7 Drawing Sheets

(56) References Cited

U.S. PATENT DOCUMENTS 7,052,445 B2 * 5/2006 Ekhaus ..... A63B 21/0601 482/108
7,152,862 B1 * 12/2006 Chiu ..... A63F 7/044 273/109
7,175,573 B1 * 2/2007 Huang ..... A63B 21/0004 446/236
7,326,158 B1 * 2/2008 Wang ..... A63B 21/06 482/132
7,381,157 B2 * 6/2008 Blateri ..... A63B 21/075 482/106
7,585,262 B1 * 9/2009 Vayntraub ..... A63B 23/12 482/141
7,883,452 B1 * 2/2011 Chen ..... A63B 21/072 482/108
8,083,649 B1 * 12/2011 Cordova ..... A63B 21/00069 482/45
8,105,218 B1 * 1/2012 Vayntraub ..... A63B 23/1236 482/141
8,267,845 B2 * 9/2012 Taylor ..... A63B 26/003 482/140
8,382,647 B1 * 2/2013 Hodes ..... A63B 21/072 482/108
8,454,483 B1 * 6/2013 Bradley ..... A63B 21/072 482/44
8,870,719 B2 * 10/2014 Johnson ..... A63B 21/072 482/44
8,911,334 B1 * 12/2014 Cotter ..... A63B 43/02 482/105
8,944,971 B2 * 2/2015 Shorter ..... A63B 21/075 482/107
10,004,660 B2 * 6/2018 Hobbs ..... A61H 39/007
10,076,685 B2 * 9/2018 King ..... A63B 69/0071
2003/0186790 A1 * 10/2003 Yu ..... A63B 21/0608 482/110
2004/0222588 A1 * 11/2004 Wu ..... A63B 43/00 273/153 R
2005/0101454 A1 * 5/2005 Dworzan ..... A63B 21/22 482/110
2007/0225133 A1 * 9/2007 Castro ..... A63B 21/0004 482/140
2008/0081744 A1 * 4/2008 Gormley ..... A63B 21/072 482/93
2008/0305935 A1 * 12/2008 Sanghavi ..... A63B 21/0023 482/91
2011/0251029 A1 * 10/2011 Verheem ..... A63B 21/0004 482/110
2011/0263394 A1 * 10/2011 Viselman ..... A63B 21/00061 482/93
2012/0053024 A1 * 3/2012 Mendoza ..... A63B 21/072 482/106
2012/0157270 A1 * 6/2012 Johnson ..... A63B 21/072 482/93
2012/0184418 A1 * 7/2012 Wilson ..... A63B 21/00043 482/112
2012/0322631 A1 * 12/2012 Januszek ..... A63B 21/072 482/108
2013/0059701 A1 * 3/2013 Santa Cruz ..... A63B 21/0606 482/108
2013/0316886 A1 * 11/2013 Lynch ..... A63B 26/003 482/146
2014/0005011 A1 * 1/2014 Hess, II ..... A63B 21/06 482/106
2015/0290076 A1 * 10/2015 Hobbs ..... A61H 39/007 601/46
2015/0321041 A1 * 11/2015 Stephan ..... A63B 43/02 482/132
2016/0001136 A1 * 1/2016 King ..... A63B 69/0071 320/108
2019/0125623 A1 * 5/2019 Spratt ..... A61H 15/0092

* cited by examiner

100

EXERCISE BALL

TECHNICAL FIELD

The disclosure relates generally to an exercise ball. In particular, the disclosure relates to an exercise ball that can be separated into independent sections for weight training in Tai Chi exercise.

BACKGROUND

Several types of exercise balls can be utilized to promote physical and mental health. In particular, wooden Tai Chi balls are exercise balls that can be utilized to perform various physical and mental health exercises. However, historically Tai Chi balls are used for light physical exercises and are not used in weight training. Thus, users whose lean mass is reduced, such as from aging, cannot effectively benefit from physical exercise using Tai Chi balls.

SUMMARY

Embodiments of the present disclosure may provide an exercise ball that may include a separable first section, a separable second section, and a plurality of polymagnets that may be provided in an interior of the exercise ball. The plurality of polymagnets may attach and detach the separable first section and the separable second section. A core may be arranged in the interior of the exercise ball and may include a hollow hole. The separable first section and the separable second section may be weighted. The separable first section may be held in a user's first hand and the separable second section may be held in the user's second hand. A user may utilize the separable first section and the separable second section for weight training. The exercise ball may provide an audio module, and the plurality of polymagnets may provide a twist-release attachment and detachment of the separable first section and the separable second section. The exercise ball may include at least one detent that may be arranged below the plurality of polymagnets. The at least one detent may provide a latched position of the separable first section with the separable second section. The separable first section may be one pound, 1.75 pounds, or 2.5 pounds in weight, and the separable second section may be one pound, 1.75 pounds, or 2.5 pounds in weight.

Other embodiments of the present disclosure may provide a Tai Chi ball that may include a separable first section and a separable second section. The separable first section may provide a decorative Yin or Yang exterior, and the separable second section may provide a decorative Yin or Yang exterior that may be opposite of the separable first section. A plurality of polymagnets may be provided in an interior of the Tai Chi ball, and the plurality of polymagnets may attach and detach the separable first section and the separable second section. The Tai Chi ball may include a core that may be arranged in the interior of the Tai Chi ball and may include a hollow hole. The separable first section and the separable second section may be used for mind-body exercises and/or weight training. The separable first section may be arranged to be held in a user's first hand, and the separable second section may be arranged to be held in the user's second hand. A user may utilize the separable first section and the separable second section for weight training, and the separable first section and the separable second section may be weighted. The Tai Chi ball may include an audio module, and the plurality of polymagnets may provide a twist-release attachment and detachment of the separable first section and the separable second section. The Tai Chi ball may include at least one detent that may be arranged below the plurality of polymagnets. The at least one detent may provide a latched position of the separable first section with the separable second section. The separable first section may have a weight selected from one pound, 1.75 pounds, or 2.5 pounds, and the separable second section may have a weight selected from one pound, 1.75 pounds, or 2.5 pounds.

Other technical features may be readily apparent to one skilled in the art from the following drawings, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Embodiments of the present disclosure may provide an exercise ball that may be separated into sections. The exercise ball may be separated into two independent sections that may be used for weight training and mind-body exercises. The exercise ball may be a Tai Chi ball that may provide a combination of mind-body exercises and weight or strength training.

Figure 1:
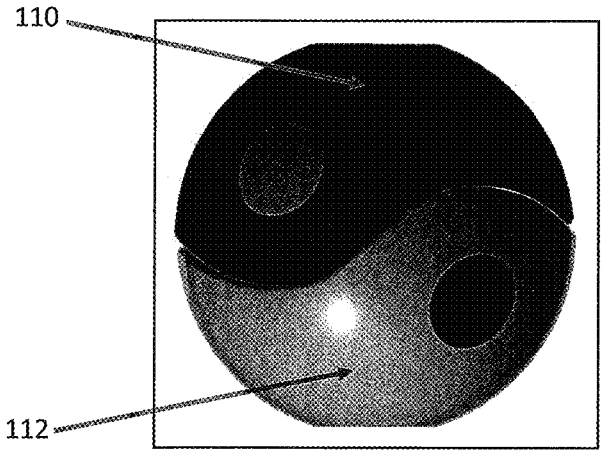
FIG. 1 depicts a front view of an exercise ball according to an embodiment of the present disclosure.
Figure 2A:
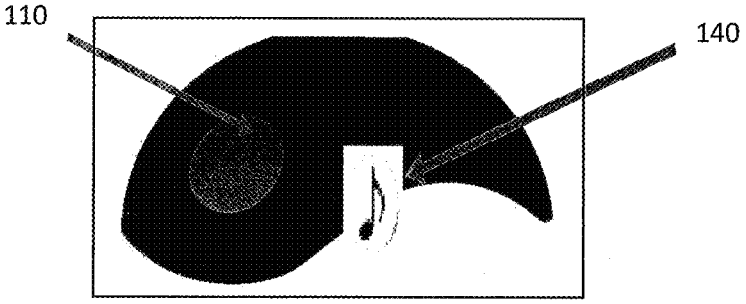
FIG. 2A depicts a front view of a section of an exercise ball according to an embodiment of the present disclosure.
Figure 2B:
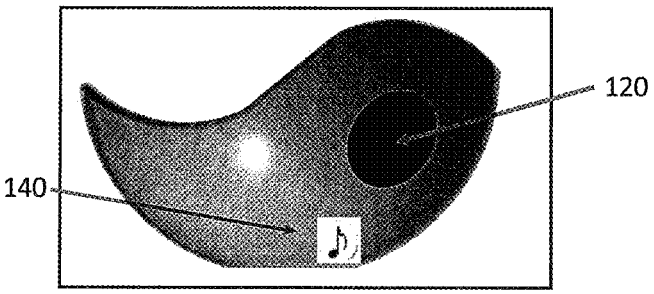
FIG. 2B depicts a front view of another section of an exercise ball according to an embodiment of the present disclosure.

As shown in FIGS. 1, 2A, and 2B, according to an embodiment of the present disclosure, exercise ball 100 may provide first section 110 and second section 120. First section 110 and second section 120 may be in combined and attached position 150 (FIG. 3B) to form exercise ball 100. First section 110 and second section 120 may each provide a decorative exterior. For example, exercise ball 100 may be a Tai Chi ball, and first section 110 and second section 120 may form Yin and Yang decorated sections, respectively, in an embodiment of the present disclosure. However, it should be appreciated that exercise ball 100, first section 110, and/or second section 120 may include any decorative exterior without departing from the present disclosure. It also should be appreciated that any number of sections may be included in exercise ball 100 without departing from the present disclosure.

Exercise ball 100 may provide audio module 140 (FIGS. 2A, 2B, 4A, and 4B) that may include a music player, verbal instructions, and/or other sound conveying mechanisms without departing from the present disclosure. It should be appreciated that audio module 140 may be provided in first section 110 and/or second section 120. It should also be appreciated that exercise ball 100 may not provide audio module 140 features without departing from the present disclosure.

Figure 3A:
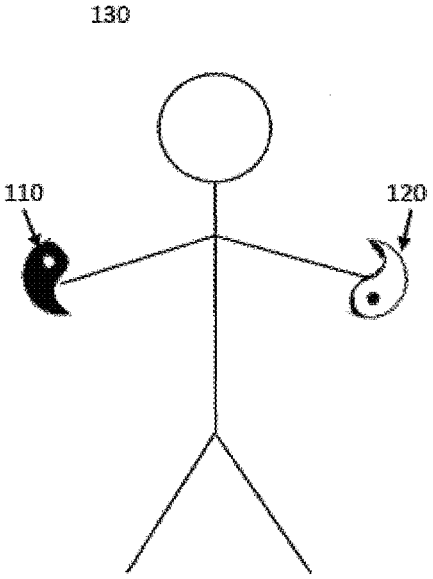
FIG. 3A depicts a separated and detached exercise ball according to an embodiment of the present disclosure.
Figure 3B:
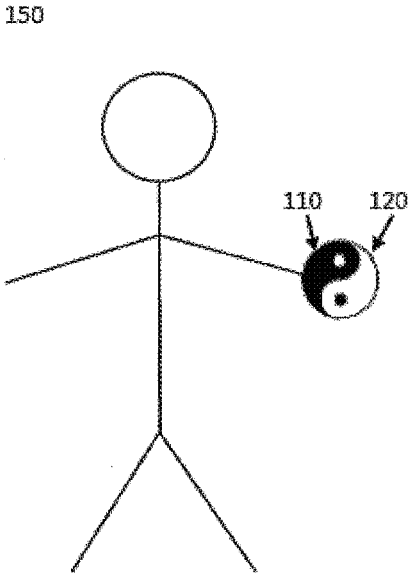
FIG. 3B depicts a combined and attached exercise ball an according to an embodiment of the present disclosure.

As shown in FIGS. 3A and 3B, according to an embodiment of the present disclosure, first section 110 and/or second section 120 may be weighted and may be used for weight training in combined and attached position 150 and also in separated and detached position 130. It should be appreciated that when exercise ball 100 is in separated and detached position 130, first section 110 and second section 120 are completely separated and independent sections. First section 110 may be held in a user's hand and second section 120 may be held in the user's opposite hand. The user may perform poses and exercises with exercise ball 100 and/or first section 1110 and second section 120 in separated and detached position 130. It should be appreciated that exercise ball 100 may refer to first section 110 and second section 120 in both combined and attached position 150 and in separated and detached position 130.

Poses and exercises with exercise ball 100 or components thereof may improve the user's strength and exercise the user's body. It should be appreciated that exercise ball 100 may have a weight that may be 2 pounds, 3.5 pounds, or 5 pounds, in which first section 110 and second section 120 may each have a weight of 1 pound, 1.75 pounds, and 2.5 pounds, respectively. It should be appreciated that exercise ball 100 may have a weight that may be more or less than a range of 2 to 5 pounds without departing from the present disclosure. It should be appreciated that first section 110 and second section 120 may have different weights without departing from the present disclosure. Exercise ball 100 may provide a size and/or a weight that may be compatible with a user's stature, physical fitness, and/or health goals.

It should be appreciated that exercise ball 100 may be made of a material that may be formed using blow molding. It should further be appreciated that blow molding to form exercise ball 100 may be performed using extrusion, injection, biaxial stretch, and/or co-extrusion blow molding in embodiments of the present disclosure. However, it should be appreciated that exercise ball 100 may be formed through techniques other than blow molding without departing from the present disclosure.

Exercise ball 100 may be utilized to integrate weight training and mind-body exercises and may provide a structure that may provide resistance for strength training and meditative exercises. Exercise ball 100 may promote physical and mental health and may provide strength and weight training by offering a combination of mind-body exercise and weight training. It should be appreciated that exercise ball 100 may be a Tai Chi ball that may weigh 2 lbs., or 3.5 lbs., or 5 lbs. It should also be appreciated that exercise ball 100 may weigh less than 2 lbs. or may be 5 lbs. without departing from the present disclosure.

Exercise ball 100 may be designed based on the Yin and Yang theory in which device 100 may be separated into Yin part or first section 110 and Yang part or second section 120. Exercise ball 100 may be utilized in different forms for exercise including, but not limited to, the forms provided in Table 1. It should be appreciated that exercise ball 100 may be in separated and/or detached in the different forms. It should also be appreciated that an artistic design may be provided on exercise ball 100 and may increase fun and enjoyment during exercise and/or meditation.

TABLE 1

Exercise Ball Forms.

| Form | Position of Exercise Ball 100 |
|---|---|
| 1. Commencing Form | Separated and Detached Position 130 |
| 2. Part Wild Horse's Mane | Separated and Detached Position 130 |
| 3. Brush Knee and Push Forward | Separated and Detached Position 130 |
| 4. Curling the Arms | Separated and Detached Position 130 |
| 5. Left Grasp the Peacock's Tail | Combined and Attached Position 150<br>Left Hand of User May Hold Exercise Ball 100 and Transfer to Right Hand of User |
| 6. Right Grasp the Peacock's Tail | Combined and Attached Position 150<br>Right Hand of User May Hold Exercise Ball 100 and Transfer to Left Hand of User |
| 7. Wave Hands Like Clouds | Combined and Attached Position 150<br>Leading Arm of User May Hold Exercise Ball 100 |
| 8. White Crane Spreads its Wing | Combined and Attached Position 150<br>User May Transfer Exercise Ball 100 to Right Hand |
| 9. Open and Close Hands | Separated and Detached Position 130 |
| 10. Appear Closed | Separated and Detached Position 130 |
| 11. Crossing Hands | Separated and Detached Position 130 |
| 12. Closing Form | Separated and Detached Position 130 |

Exercise ball 100 may be utilized to provide aerobic exercise by utilizing the user's body weight. Exercise ball 100 may prompt the user to shift body weight from one leg to another during slow and continuous movement that may improve balance and flexibility. Exercise ball 100 may increase target muscular strength while a user holds exercise device 100, first section 110, and/or second section 120 in one or both hands.

Figure 4:
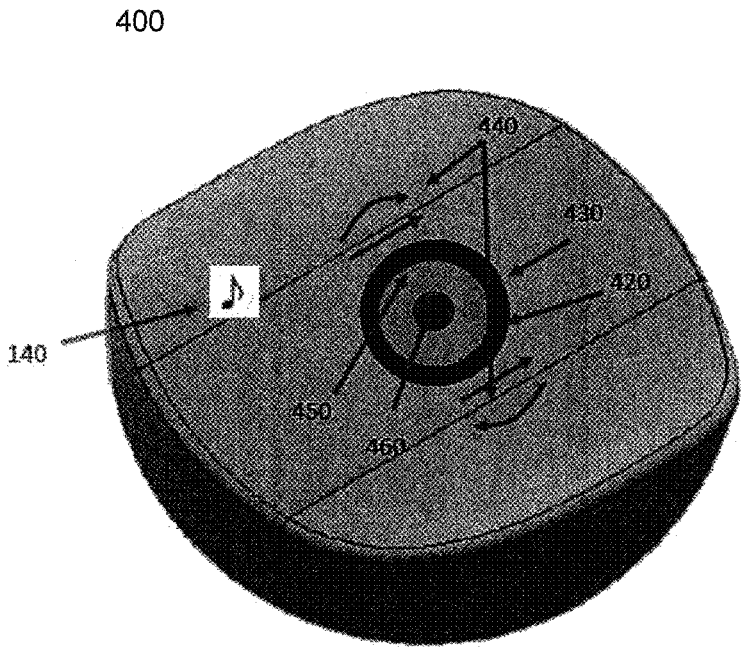
FIG. 4 depicts a perspective sectional view of an interior of an exercise ball according to an embodiment of the present disclosure.

As shown in FIG. 4, according to an embodiment of the present disclosure, exercise ball 100 may provide interior 400 that may include a plurality of polymagnets 420 positioned in area 430. The plurality of polymagnets 420 may employ twist-release locking/unlocking motion 440 that may attach and detach first section 110 with second section 120. Detent(s) 450 may be provided below polymagnets and may enable the user to easily separate and combine first section 110 and second section 120 of exercise ball 100 during exercise, such as during Tai Chi. Detent(s) 450 may provide different angles that may help align plurality of polymagnets 420 and may provide strong holding of the plurality of polymagnets 420. The plurality of polymagnets 420 may exhibit a high attraction force when axially aligned and may provide a high repellant force when rotated approximately 45 degrees clockwise and/or counterclockwise. Rotation of approximately 45 degrees may form twist-release locking/unlocking motion 440. It should be appreciated that the plurality of polymagnets 420 may be programmed to behave in different manners including, but not limited to, being programmed as spring, latch, and/or release and align polymagnets. Detent(s) 450 may keep magnetic pairs of plurality of polymagnets 420 or other types of magnets in separated and detached position 130 until explicitly rotated back to combined and attached position 150.

Different weights of exercise ball 100 may be adjusted by fillers that may consist of a combination of BB ammo and epoxy or other materials. Interior 400 of exercise ball 100 may have a core that may be hollow hole 460 that may be arranged to include fillers. An epoxy may be utilized to attach fillers that may be inside of hole 460 to interior 400 of exercise ball 100, as well as to adjust an exact weight of exercise ball 100 during a manufacturing process. Exercise ball 100 may be filled with objects that may include, but are not limited to, BB gun balls. The objects may fill exercise ball 100 to provide different weights and sizes of exercise ball 100 including, but not limited to, a 2-lb. ball having a 4-inch diameter, a 3.5-lb. ball having a 5-inch diameter, or a 5-lb. ball having a 6-inch diameter. Flat head screw and nut 410 may be provided to allow exercise ball 100 to rotate or adjust to different positions. It should be appreciated that exercise ball 100 may be separated into two parts, or first section 110 and second section 120, that may be a Yin part and a Yang part that may be combined as a whole ball using polymagnets in embodiments of the present disclosure.

Figure 5:
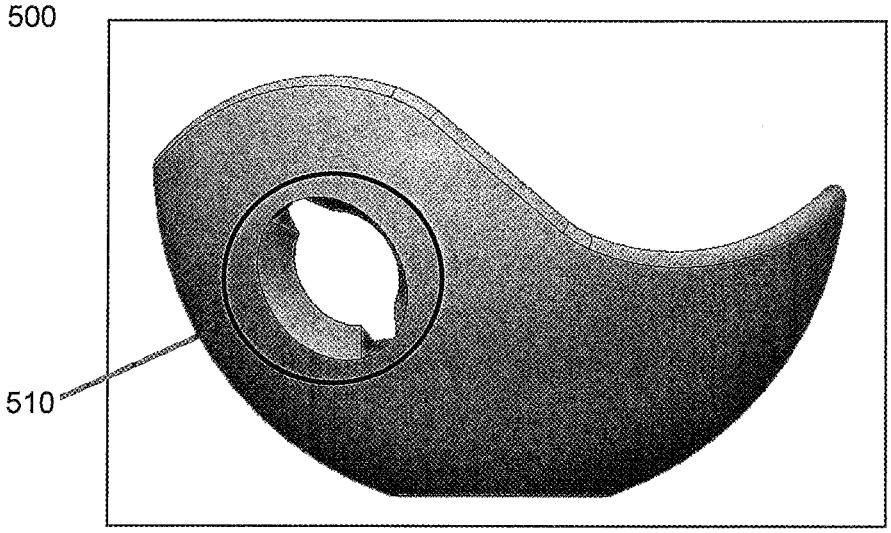
FIG. 5 depicts a perspective view of a section of an exercise ball according to an embodiment of the present disclosure.
Figures 6A, 6B:
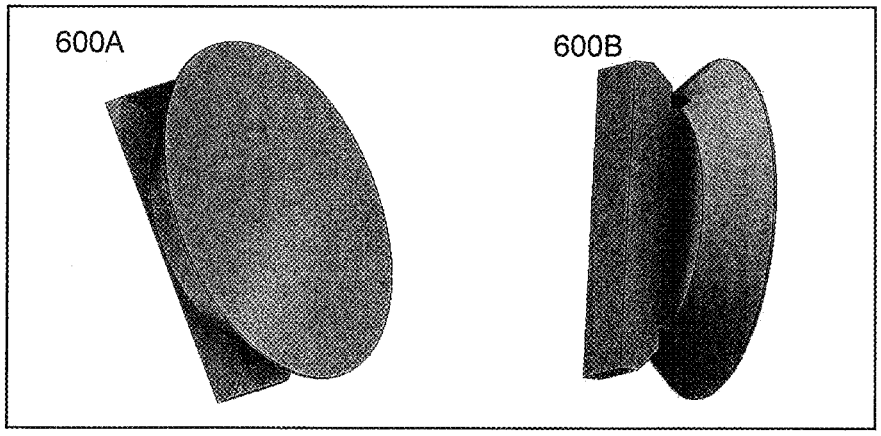
FIG. 6A depicts a perspective view of a removable portion of an exercise ball according to an embodiment of the present disclosure.
FIG. 6B depicts a perspective view of the removable portion of the exercise ball of FIG. 6A according to the present disclosure.

As shown in FIG. 5, according to an embodiment of the present disclosure, exercise ball 100 may provide first section 110 (FIG. 2A) and/or second section 120 (FIG. 2B) that may be formed as Yin and/or Yang symbols that may include hole 510. Hole 510 may be provided to receive button 600A (FIG. 6A) and 600B (FIG. 6B). Hole 510 may receive button 600A (FIG. 6A) and 600B (FIG. 6B) when inserted and twisted approximately 90 degress to lock into hole 510.

As shown in FIGS. 6A and 6B, according to an embodiment of the present disclosure, exercise ball 100 may provide first section 110 (FIG. 2A) and/or second section 120 (FIG. 2B) that may be formed as Yin and/or Yang symbols that may include button 600A, 600B. Button 600A, 600B may be inserted and lock inside of hole 510. When inserted, button 600A, 600B may twist approximately 90 degress to lock into hole 510. It should be appreciated that buttons 600A, 600B may be made using 3-D printing; however, buttons 600A, 600B may be made using other manufacturing processes without departing from the present disclosure.

Figure 7:
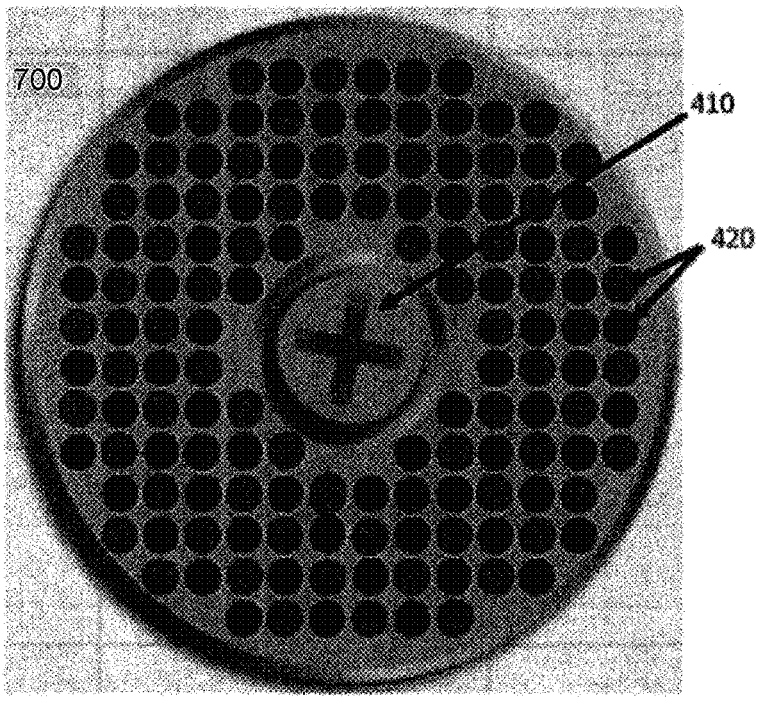
FIG. 7 depicts a side sectional view of an exercise ball according to an embodiment of the present disclosure.

As shown in FIG. 7, according to an embodiment of the present disclosure, exercise ball 100 may be formed of materials including, but not limited to, thermoplastic, plastic ball materials, a plastic injection molder, BB Ammo or steel balls with epoxy, and thin flat head screw and nut 410. Hollow hole 460 may receive filler than may be introduced into the interior or core of exercise ball 100. It should be appreciated that exercise ball 100 may provide a spherical shape or body without departing from the present disclosure.

Figure 8:
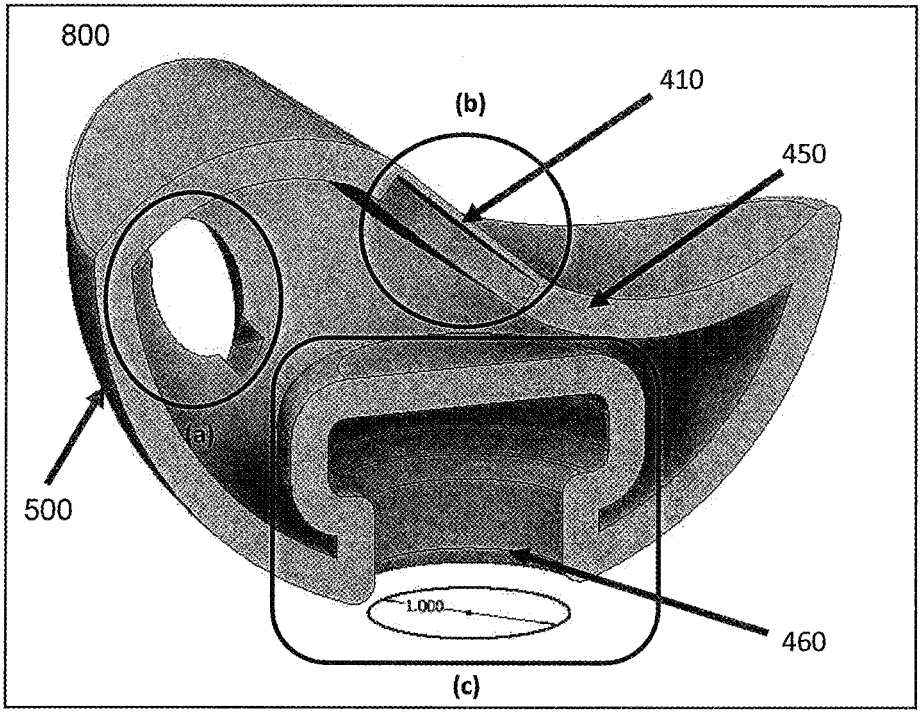
FIG. 8 depicts a perspective view of a section of an exercise ball according to an embodiment of the present disclosure.

As shown in FIG. 8, according to an embodiment of the present disclosure, exercise ball 100 may provide a Tai Chi-ball configuration. Hole 510 may be provided to receive button 600A (FIG. 6A) and 600B (FIG. 6B). Flat head screw and nut 410 may be provided to allow exercise ball 100 to rotate or adjust to different positions.

Detent(s) 450 may be provided below polymagnets and may enable the user to easily separate and combine first section 110 (FIGS. 1, 2A, and 3A-3B) and second section 120 (FIGS. 1, 2B, and 3A-3B) of exercise ball 100 during exercise, such as during Tai Chi. Detent(s) 450 may provide different angles that may help align plurality of polymagnets 420 (FIGS. 4A and 7) and may provide strong holding of the plurality of polymagnets 420.

A core may provide hollow hole 460 that may be arranged to include fillers. An epoxy may be utilized to attach fillers that may be inside of hole 460, and hole 460 may be made to receive a user's finger(s) for gripping or grapping exercise ball 100. It should be appreciated that hole 460 may have a one-inch diameter and a thickness of the inner to outer perimeter of exercise ball 100 may be approximately 0.4 inches. It should further be appreciated that the diameter of hole 460 and the thickness of exercise ball 100 may be more or less than one-inch and 0.4 inches, respectively.

It should be appreciated that exercise ball 100 may be utilized in many different environments including, but not limited to, health clubs, rehabilitation centers, assisted living facilities, and nursing homes. It should be appreciated that exercise ball 100 may be beneficial to a senior population or a population including individuals over 60 years of age and/or individuals having trouble with mobility or balance. It should further be appreciated that exercise ball 100 may improve mobility and balance among these groups.

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An exercise ball for strength or weight training, comprising:

a separable first section formed in the shape of a Yin symbol;

a separable second section formed in the shape of a Yang symbol;

a core in an interior of the exercise ball including a hollow hole that receives an adjustable amount of fillers that selectively changes a weight of the exercise ball;

a plurality of magnets provided in the interior of the exercise ball, wherein the plurality of magnets attach and completely detach the separable first section and the separable second section during the strength or weight training; and wherein the plurality of magnets provide a twist-release attachment and detachment of the separable first section and the separable second section.

2. The exercise ball of claim 1, wherein the separable first section is arranged to be held in a user's first hand and the separable second section is arranged to be held in the user's second hand when detached from one another.

3. The exercise ball of claim 1 further comprising:

an audio module.

4. The exercise ball of claim 1, further comprising:

a button that inserts and twists approximately 90 degrees to lock into the hollow.

5. The exercise ball of claim 1 further comprising:

at least one detent arranged below the plurality of magnets, wherein the at least one detent provides a latched position of the separable first section with the separable second section.

6. The exercise ball of claim 1, wherein the separable first section has a weight selected from one pound, 1.75 pounds, or 2.5 pounds.

7. The exercise ball of claim 1, wherein the separable second section has a weight selected from one pound, 1.75 pounds, or 2.5 pounds.

8. A Tai Chi ball used in weight and strength training, comprising:

a separable first section, wherein the separable first section provides a decorative Yin or Yang-shaped exterior;

a separable second section, wherein the separable second section provides a decorative Yin or Yang-shaped exterior opposite the separable first section;

a core in an interior of the exercise ball including a hollow hole that receives an adjustable amount of fillers that selectively changes a weight of the Tai Chi ball;

a plurality of magnets provided in the interior of the Tai Chi ball, wherein the plurality of magnets attach and completely detach the separable first section and the separable second section during strength and weight training; wherein the plurality of magnets provide a twist-release attachment and detachment of the separable first section and the separable second section.

9. The Tai Chi ball of claim 8, wherein the separable first section and the separable second section provides mind-body exercises and weight training to users.

10. The Tai Chi ball of claim 8, wherein the separable first section is arranged to be held in a user's first hand and the separable second section is arranged to be held in the user's second hand.

11. The Tai Chi ball of claim 8 further comprising:

an audio module.

12. The Tai Chi ball of claim 8, further comprising:

at least one detent arranged below the plurality of magnets, wherein the at least one detent provides a latched position of the separable first section with the separable second section.

13. The Tai Chi ball of claim 8, wherein the separable first section has a weight selected from one pound, 1.75 pounds, or 2.5 pounds.

14. The Tai Chi ball of claim 8, wherein the separable second section has a weight selected from one pound, 1.75 pounds, or 2.5 pounds.

* * * * *